United States Patent [19]

Klöhn et al.

[11] 4,452,145

[45] Jun. 5, 1984

[54] PROPELLANT FOR BASE-BLEED GAS GENERATORS AND PROCESS FOR MANUFACTURING IT

[75] Inventors: Wolfgang H. R. Klöhn, Pfinztal; Dieter H. Müller, Karlsruhe; Hiltmar A. O. Schubert, Walzbachtal, all of Fed. Rep. of Germany

[73] Assignee: S.A. PRB Societe Anonyme, Brussels, Belgium

[21] Appl. No.: 234,603

[22] Filed: Feb. 17, 1981

[30] Foreign Application Priority Data

Feb. 21, 1980 [DE] Fed. Rep. of Germany ..... 3006475

[51] Int. Cl.[3] ..... F42B 11/00

[52] U.S. Cl. ..... 102/501; 102/370; 102/513; 149/3; 149/7; 149/42; 149/76; 149/109.6

[58] Field of Search ..... 149/3, 7, 42, 76, 109.6; 102/370, 513, 501

[56] References Cited

U.S. PATENT DOCUMENTS

| | | | |
|---|---|---|---|
| 3,480,488 | 11/1969 | Rudy et al. | 149/7 |
| 3,539,377 | 11/1970 | Steinle | 149/7 |
| 3,954,526 | 5/1976 | Mangum et al. | 149/7 |
| 4,124,418 | 11/1978 | Reed et al. | 149/7 |

*Primary Examiner*—Stephen J. Lechert, Jr.
*Attorney, Agent, or Firm*—Bacon & Thomas

[57] ABSTRACT

Process for the manufacture of a propellant for base-bleed gas generators, thus for generators made of a gas-producing charge for the increase of range wherein a binder and one or more granular or powdery solid substances are used at least one of which is an oxidant, characterized thereby that the binder is a thermoplastically deformable elastomer, that solvents are added to said elastomer which is thoroughly mixed with the solid substance and that said elastomer is deposited thereon by removal of the solvent with the formation of a granulate.

18 Claims, No Drawings

PROPELLANT FOR BASE-BLEED GAS GENERATORS AND PROCESS FOR MANUFACTURING IT

This invention relates to a process for the manufacture of a propellent for base-bleed gas generators, thus for generators consisting of a gas-producing charge for increase of the range, wherein one or more granular or powdery solid substances, of which at least one is an oxidant, and a binder are used; it also relates to a propellant for base-bleed generators, thus generators with a gas-producing charge having a binder and one or more granular or powdery solid substances, of which at least one is an oxidant.

With the wording "base-bleed gas generators" generator motors are meant that are used for the increase of range of projectiles without the projectiles being actively accelerated.

In order to enlarge the range of projectiles of artillery guns, e.g. of a projectile of 155 mm, a propellant set is arranged in a chamber at the bottom of the projectile. This propellant set effects an after-acceleration of the projectile. A disadvantage of such an after-accelerating propellant set is that the after-acceleration effects a deterioration of the firing image as a result of a greater dispersion. Moreover, the rocket combustion chamber under the projectile increases the weight of the projectile considerably so that an increase of range is reached that is less than proportional with respect to the energy applied. As in addition thereto for ballistic reasons the length of such a projectile cannot essentially be increased, the effective space of the projectile is reduced by the greater volume claimed by a projectile propellant set. Moreover, such an active accelerating propellant set is quite complicated and hence requires a large expenditure.

By reason of these disadvantages and of the fact that no active high-power acceleration is needed in order to achieve a sufficient increase of range, one limits itself to the increase of range on so-called base-bleed gas generators. In these generators the burning gases leave the projectile with a slight overpressure of 0.1 to 2 MPa in the combustion chamber. The burn-up speed lies between 0.5 and 5 mm/s.

Herein no active acceleration of the projectile is reached any more. After the projectile has left the gun barrel the propellant set of the gas generator is ignited and the outcoming gases only fill the vacuum formed at the projectile bottom during the flight. This vacuum causes a base drag, which decreases the range of a projectile. This vacuum being filled up by the gases flowing out of the projectile base, an effective neutralization of base drag is achieved so that the projectile can fly farther. In comparison with active propellant sets approximately equal range increases of about 30% can be obtained at a smaller expenditure. In that no active acceleration of the projectile is used but that only the vacuum forming behind the projectile is filled, a better hit image is reached than with a rocket projectile.

Conventionally the propellants for such base-bleed gas generators can only be manufactured as formed blockshaped solid, thus especially as ready propellant set without the non-shaped propellants by themselves being suitable for storage. Base-bleed gas generators of that kind are described in the Belgian Patent Specification No. 834.903.

According to known manufacturing processes propellants and propellant sets of base-bleed gas generators are made as follows : an oxidant, e.g. ammonium perchlorate, and optionally other solid substances such as aluminum as a fuel or the like, are mixed with a liquid binder, viz. e.g. polybutadiene so as to form a highviscous mass, thus a paste, thereupon cast while a hardener is added, and cured at 50° to 80° C. for 4 to 7 days.

A disadvantage of the known process is that the raw propellant made of a binder and oxidant cannot be made for storage purposes, as the suspension separates out on the one hand and because there is a risk of permanently hardening on the other hand. In addition thereto, it is cumbersome from a standpoint of manufacture to fill in small charges by pouring high-viscous masses in moulds for making small propellant sets. Therefore, the laborious method of casting the propellant in large blocks has to be followed, from which the propellant sets are finally manufactured in the appropriate shape by cutting and turning.

It is an object of the present invention to avoid the mentioned disadvantages and to provide a process for manufacturing propellants that can be stored without any problem, easily be handled and further be worked up to arbitrary propellant sets.

The process of the present invention for the manufacture of propellants is characterized thereby that the binder is a thermoplastically deformable elastomer, that this elastomer is mixed with solvents, is thoroughly mixed with the solid substance and then is deposited thereon by removing the solvents with the formation of a granulate.

Another object of the invention is to provide a propellant which possesses none of the above-mentioned disadvantages, that can be stored without any problem, and further can be worked up to arbitrary propellant sets.

According to the present invention a propellant set is characterized thereby that the binder is a thermoplastically deformable elastomer, that the propellant has a granular form and that the particles of solid are incorporated in the thermoplastically deformable elastomer with the formation of a granulate.

Finally, it is provided according to the present invention in contradistinction to the prior art that a process is elaborated for the manufacture of propellant sets for base-bleed gas generators or generators made of a gas-producing charge for the increase of range and having a binder and one or more granular or powdery solid substances, at least one of which being an oxidant, especially made of a propellant, characterized thereby that the solids and the plastically deformable binder elastomer having the form of a granulate are formed at elevated temperatures and are provided with an insulating envelope.

In the process of the present invention trichloroethane or trichloroethylene are used as a solvent. Ammonium perchlorate or ammonium nitrate or a similar compound are used as an oxidant.

It is obtained according to the present invention that the solid substances are incorporated into thermoplastically deformable elastomers, stored in this state and then on the basis of the thermoplastic deformability of these elastomers can be shaped by compression in any form at an elevated temperature and high pressure.

According to the present invention the following advantages are realized. It is possible to manufacture the propellant as a granulate and to store it. The granulates, which are available as starting products, can simply be mixed and distributed in a solution without any problem. So, a method of making the propellants according to the present invention without any trouble is provided. Correspondingly also the working up to the propellant set can simply be carried out in the way according to the present invention.

Otherwise no change of the distribution between the solids, thus especially the oxidant and the binder, can occur as is possibly by the segregation in the casting process with liquid binders according to the prior art, since no sedimentation takes place upon working up the granular propellant according to the present invention by compression so as to form the propellant set.

According to a preferred embodiment of the process of the invention the thermoplastically deformable elastomer is a three-block polymer, especially a copolymer of butadiene and styrene or of isoprene and styrene with regular molecular arrangement. It has been observed that this thermoplastically deformable elastomer is the best soluble in the solvents mentioned.

According to another preferred embodiment of the process of the invention the solvent is eliminated by evaporation under vacuum. As a result thereof the thermoplastically deformable elastomer deposits on the solid particles, thus especially on the particles of oxidant. In this embodiment of the process a deposition of the elastomer on the solid substance and a removal of the solvent are thus effected simultaneously. According to another preferred embodiment these steps can be carried out subsequently in that the elastomer is precipitated on the solid substance or substances by the addition of a non-solvent, and that the remaining mixture of solvent and non-solvent is filtered with suction.

So, first a precipitation in the suspension is achieved, the elastomers depositing on the solid substances. The liquid is eliminated only thereafter, which can take place by sucking off through a suction filter. Acetone is an example of a non-solvent.

For controlling the burn-up speed it can further be provided according to still another embodiment of the present invention that high-energy solid components can be added to the oxidant for forming a mixture of solids. Solids that can be used are e.g. nitroguanidine, guanidine nitrate, hexogene, octogene and pentaerythrite tetranitrate.

In addition to burn-up moderators and the stabilizers which are added to the mixture at a suitable moment of the process sequence in an advantageous embodiment of the process, a plasticizer such as triocytl phosphate can be added to the binder.

Mixing all the components in the solution is advantageously carried out at an elevated temperature. Especially, the final mixing takes place at about 80° C.

In order to remove even the last traces of solvent from the remaining granulate it is advantageous to dry the granulate and to proceed in this way until the amount of volatile components becomes smaller than 0.1%.

Other advantages and characteristics of the present invention appear from the claims and the description hereinafter, wherein an embodiment of the process of the present invention and an example of the propellant according to the invention are disclosed detailedly.

According to a concrete embodiment of the process of the present invention 550 g of ammonium perchlorate as an oxidant and 250 g of nitroguanidine as additional fuel and controlling agent of the burn-up speed, which both products are in granulate form, are mixed with each other in a duplex horizontal mixer. To this mixture of solid granulate a 10% solution of copolymeres of butadiene and styrene in trichloroethane is added, the proportion of this copolymer being about 180 g. The granulates of solid substances and the 10% solution of butadiene styrene copolymer in trichloroethane are thoroughly mixed. Thereupon 20 g of trioctyl phosphate are added to the suspension as a plasticizer. The whole suspension is then further mixed at about 80° C., whereafter the solvent is made to evaporate in vacuum and removed.

As an alternative of removing the solvent in vacuum a sufficient amount of acetone can be added to the solution mixture as a non-solvent, whereby the dissolved copolymer of butadiene and styrene is made to precipitate on the solid substances. Subsequently, the mixture of trichloroethane and acetone is separated from the solid substances by filtering with suction.

In both cases a granulate is left whose separate particles have been coated with an envelope of the butadiene-styrene copolymer binder.

Residual traces of solvent are removed from the granulate by drying the granulate with its copolymer coating at about 50° C. for 12 h. For the quantities of the example this drying is carried out in a lacquer-drying cabinet. After this drying step the portion of volatile components amounts to less than 0.1%.

An embodiment of the propellant of the present invention consists of a granulate wherein the solid components such as ammonium perchlorate as an oxidant and nitroguanidine as an additive fuel and controlling agents of the burn-up speed are coated with an envelope of butadiene-styrene copolymer as a binder and with a small proportion of trioctyl phosphate as a plasticizer. The different components are present in the solid granulate in the following proportion: ammonium perchlorate 55%-nitroguanidine 25%-trioctyl phosphate 2%-copolymer of butadiene and styrene 18%.

The propellant with granulate form according to the present invention can be stored for a practically unrestricted period of time without its properties being altered. For homogenization purposes of the charges it can simply be mixed before further working up. The propellant of the invention can be worked up according to the present invention to propellant sets by filling the propellant granulate in a mould and compressing it therein at an elevated temperature. Either an insulating envelope for the propellant set is already present in the mould, or this envelope is applied to the propellant set by subsequent coating. The propellant set containing the propellant according to the invention e.g. has a length of 130 mm, a diameter of 120 mm and a central channel with a diameter of 43.5 mm. The purpose of the central channel is, as in the case of the burn-up, which takes place from this central channel to the outside, to conduct the gases produced out of the propellant set in an orderly way. The propellant set can have the form of two semi-cylinders having each a longitudinal recess with semi-circular section, so that the longitudinal combustion channel forms upon assembling both the semicilynders in the generator. A base-bleed gas generator or a generator having a propellant set made of the propellant according to the present invention for producing a bottom outflow of gas at a projectile allows the gas to flow out at a pressure of about 0.11 MPa at a burn-up speed of 1.11 mm/s, at 0.89 MPa at a Burn-up speed of 3.0 mm/s and at 1.37 MPa at a burn-up speed of 3.4 mm/s respectively.

The maximum tensile strength of the propellant of the present invention at 20° C. and at a rate of feed of 50 mm/s amounts to 0,51 N/mm2 and the corresponding elongation is larger than 150%. The density of the propellant according to the present invention is about 1.52 g/cm3 for the propellant set compressed at 100 to 140° C. at a pressure of 20 to 50 MPa.

The characteristics of the present invention disclosed in the foregoing description and in the claims can be essential separately as well as in arbitrary combinations for the realization of the invention in its different embodiments.

What I claim is:

1. A process for making a propellant for base-bleed gas generators which comprises the steps of dissolving a thermoplastically deformable elastomer in a solvent to form a solution with 10% elastomer, mixing at least one granulated oxidizer with said solution at a temperature of about 80° C., removing said solvent under vacuum by evaporation, and drying the resultant oxidizer particles coated with said elastomer at a temperature of about 50° C.

2. A process according to claim 1 wherein, the obtained dried end coated particles are placed into a mold and compressed at 20 to 50 MPa under a temperature between 100° C., and 140° C., to obtain a base-bleed body.

3. A process according to claim 1, characterized in that the thermoplastically deformable elastomer is a three-block polymer.

4. A process according to claim 3, characterized in that the three-block polymer is a copolymer of butadiene and styrene or of isoprene and styrene with regular molecular arrangement.

5. A process according to claim 1, wherein said oxidizer is mixed with high-energy solid substances.

6. A process according to claim 1, wherein said oxidizer is mixed with burn-up moderators.

7. A process according to claim 1, wherein said oxidizer is mixed with plasticizers.

8. A process according to claim 1, wherein said oxidizer is mixed with a stabilizer.

9. A process according to claim 1, wherein said particles are dried until they possess a portion of volatile components of less than 0.1%.

10. A process according to claim 1, wherein said drying step is carried out in a period of time of about 12 hours.

11. A process for making a propellant for base-bleed gas generation which comprises the steps of dissolving a thermoplastically deformable elastomer in a solvent to form a solution with 10% elastomer, mixing at least one granulated oxidizer with said solution at a temperature of about 80° C., removing said solvent under vacuum by evaporation, and drying the resultant oxidizer particles coated with said elastomer at a temperature of about 50° C., said resultant oxidizer particles being suitable for use as a propellant in a base-bleed gas generator.

12. A base bleed gas generator comprising a propellant prepared by the process according to claim 1, wherein said propellant has a burn-up speed of between 0.5 and 5.0 mm/s.

13. A base bleed gas generator according to claim 12, wherein said burn-up speed is about 1.1 to about 3.4 mm/s.

14. A base bleed gas generator according to claim 12, wherein said gas flows out at a slight overpressure of about 0.01 to about 2.00 MPa in the combustion chamber.

15. A base bleed gas generator according to claim 13, wherein said gas flows out at a pressure of about 0.11 to about 1.37 MPa.

16. A process according to claim 2, wherein said base-bleed body has a density of about 1.52 g/cm$^3$.

17. A projectile comprising a base bleed gas generator to produce outcoming gases sufficient to fill the vacuum formed at the projectile bottom during flight, said vacuum otherwise causing a base drag, whereby said base drag is neutralized and the range of said projectile is increased by about 30% without active acceleration, said base bleed gas generator comprising a propellant prepared by the process according to claim 1, 3, 4, 5, 6, 7, 8 or 16.

18. A projectile comprising a base bleed gas generator to produce outcoming gases sufficient to fill the vacuum formed at the projectile bottom during flight, said vacuum otherwise causing a base drag, whereby said base drag is neutralized and the range of said projectile is increased by about 30% without active acceleration, said base bleed gas generator being one according to claim 12, 14 or 15.

* * * * *